US005316102A

United States Patent [19]

Bell

[11] Patent Number: 5,316,102

[45] Date of Patent: May 31, 1994

[54] SAFETY SYSTEM FOR USE IN ERECTING STATIC STRUCTURES

[76] Inventor: Michael Bell, 1705 Triumphe Way, Warrington, Pa. 18976

[21] Appl. No.: 834,421

[22] Filed: Feb. 12, 1992

[51] Int. Cl.[5] ..... A62B 35/00

[52] U.S. Cl. ..... 182/3; 182/191

[58] Field of Search ..... 182/3, 4, 5, 190, 197, 182/112, 100, 191

[56] References Cited

U.S. PATENT DOCUMENTS

| | | | |
|---|---|---|---|
| 578,145 | 3/1897 | Girtler | 182/4 |
| 1,350,136 | 8/1920 | Belly | 182/4 |
| 3,444,957 | 5/1969 | Erving, Jr. | 182/3 |
| 4,116,305 | 9/1978 | Leduc | 182/3 |
| 4,674,596 | 6/1987 | Weener et al. | 182/3 |
| 4,714,134 | 12/1987 | Grufman | 182/3 |
| 5,105,907 | 4/1992 | Lebow | 182/3 |

FOREIGN PATENT DOCUMENTS

| | | | |
|---|---|---|---|
| 271254 | 10/1950 | Switzerland | 182/3 |

*Primary Examiner*—Alvin C. Chin-Shue

*Attorney, Agent, or Firm*—Caesar, Rivise, Bernstein, Cohen & Pokotilow, Ltd.

[57] ABSTRACT

A safety system for connection to at least one fixed, elongated, structural component, e.g., an I-beam, of a static structure, e.g., a building being erected, to protect a worker located on the structure from falling thereoff. The system comprising first and second releasably securable mounting assemblies frictionally secured at respective spaced locations on the structural component, a rope or cable connected between the mounting assemblies, and a sliding anchor mounted on the rope. The sliding anchor comprising a tubular member mounted on the rope means for sliding therealong to a desired position whereupon it can be actuated to releasably secured it against further sliding. The worker wears a supporting belt, harness or other device, which is connected, via a lanyard and an associated shock absorber, to the sliding anchor, to thereby prevent he/she from falling more than a predetermined distance away from said sliding anchor.

19 Claims, 2 Drawing Sheets

SAFETY SYSTEM FOR USE IN ERECTING STATIC STRUCTURES

BACKGROUND OF THE INVENTION

This invention relates generally to safety apparatus and more particularly to a system for securement to structural components of a building to protect workers from falling and to expedite the construction or renovation of the building.

Due to the enactment of various safety laws, persons working at elevated positions, e.g., on steel construction beams of a building as it is erected, etc., are required to be protected against falls. One common approach to achieve that end is the use of a safety belt which is worn on the worker's waist. The belt includes a D-ring or some other metal loop fixedly mounted on the belt in the center of the portion located at the worker's back. The D-ring is arranged to be "tied off" (connected), via a lanyard, to a fixed supporting member or anchor point. The anchor point may be any fixed portion, e.g. an I-beam, of the building which is strong enough to support the worker's weight. The securement of the lanyard to the anchor point is typically accomplished by wrapping the lanyard at least once about the anchor point, e.g., I-beam. Thus, once the worker is tied off should he/she fall off of the structure he/she will be prevented from falling to the ground.

While this technique of preventing falls is generally suitable for its intended purposes it never the less suffers from some drawbacks. For example, it limits or restricts the movement of the worker to a small working area contiguous with the anchor point, and does not provide adequate protection to the worker when he/she is in the process of moving to a different location, e.g., adjacent another anchor point.

OBJECTS OF THE INVENTION

Accordingly, it is a general object of this invention to provide a safety system and methods of use which overcome the disadvantages of the prior art.

It is a further object of this invention to provide a safety system and methods of use which enables a worker located at an elevated position on a structure to move thereabout, all the while being protected from falling.

It is a further object of this invention to provide an safety system which is simple in construction, low in cost, yet effective for protecting a worker located at an elevated position on a structure from falling while permitting the worker to move about the structure.

It is a further object of this invention to provide a method of erecting, a static structure by a worker who is able to move about the structure while being protected from falling therefrom.

SUMMARY OF THE INVENTION

These and other objects of this invention are achieved by providing a safety system for connection to at least one fixed, elongated, structural component, e.g., an I-beam, stud, etc., of a static structure, e.g., a building being erected, repaired, reconstructed, etc., to prevent a worker from falling thereoff. The system basically comprises first and second releasably securable means, rope means, and sliding anchor means.

The first releasably securable means is arranged for encircling and frictionally engaging a first portion of the structural component. The second releasably securable means is arranged for encircling and frictionally engaging a second portion of a structural component, but spaced from said first portion. The rope means is an elongated flexible member which is connected between the first and second releasably securable means and is preferably taut or semi-taut.

The sliding anchor means comprising a hollow member through which the rope means passes so that the member can be slid therealong to a desired position. The sliding anchor is arranged to be connected to a safety device, e.g., a belt, worn by a worker to secure the worker to said sliding anchor, whereupon said worker is prevented from falling more than a predetermined distance away from said sliding anchor means. Preferably the means for connecting the sliding anchor to the safety device comprises lanyard means.

This invention also comprises methods of connecting various elongated structural components, e.g., steel I-beams, wood studs, wood beams, etc., together by a worker located at an elevated position adjacent one of the structural components, while protecting him/her from falling so that the components can be connected expeditiously. In particular in accordance with one aspect of the methods of this invention a first releasably securable means is mounted on a first portion of one of the structural members so that a portion of it encircles and frictionally engages the first portion of the structural component. In a similar manner a second releasably securable means is mounted on a second portion of a structural component so that a portion of it encircles and frictionally engages a second portion of that structural component remote from the first portion. A rope means is extended between the first and second releasably securable means and secured thereto. At least one sliding anchor means is disposed on the rope means. The sliding anchor means is arranged to slide along said rope means.

In accordance with one aspect of the methods of this invention if the rope means is oriented vertically the sliding anchor means is constructed so that it may be slid to a desired position on the rope means and actuated to releasably secure it in place at that position. In accordance with another aspect of the methods of this invention if the rope means is oriented horizontally the sliding anchor means is constructed so that it is free to slide to any position on the rope means. In either case the worker is connected to the sliding anchor means, by any suitable means, e.g., a lanyard and an associated shock absorber. This action enables the worker to conduct activities while being protected from falling no more than a predetermined distance, e.g., the length of the lanyard and shock absorber.

In accordance with another aspect of the methods of this invention vertical and horizontal structural components may be added and assembled to form the static structure. In this regard a first structural component may be oriented vertically so as to have a lower end and an upper end. The first releasably securable means is connected adjacent the lower end of the structural component and the second releasably securable means is connected thereto adjacent the upper end. The worker can make use of the system to elevate himself/herself, on the component, e.g., climb the component. A horizontal structural component can be added the structure, in which case first and second releasably securable means, rope means and sliding anchor means are mounted on it in a similar manner to that of said vertically oriented structural component. The worker can then utilize the lanyard means to transfer from the sliding anchor means associated with the rope means extending along the vertically oriented structural component to the sliding anchor associated with the rope means extending along the horizontally oriented structural component, all the while being protected from falling by the safety system.

It must be pointed out at this juncture that any suitable releasably securable mounting means, any suitable sliding anchor means, any suitable lanyard, and any suitable shock absorber can be used in the subject invention. However, it is preferable that such various components be constructed in accordance with the teachings of several of my earlier inventions. In particular, the releasably securable (mounting) means preferably comprises the means disclosed in my U.S. patent application Ser. No. 07/761,121, filed on Sept. 17, 1991, entitled Anchor System For Use With Fall Prevention Safety Devices, whose disclosure is incorporated by reference herein. The sliding anchor means preferably comprises the means disclosed in my U.S. patent application Ser. No. 07/771,666 filed on Oct. 4, 1991, entitled Sliding Anchor System And Method Of Use, whose disclosure is also incorporated by reference herein. The lanyard means preferably comprises the means disclosed in my copending U.S. patent application Ser. No. 07/816,990 filed on Jan. 3, 1992, entitled a Dual Connection Lanyard for Use In Safety System, whose disclosure is also incorporated by reference herein. Finally, the shock absorbing means preferably comprises the means disclosed my U.S. patent application Ser. No. 07/605,284, filed on Oct. 29, 1990, entitled Visually Inspectable Safety Lanyard, whose disclosure is also incorporated by reference herein.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
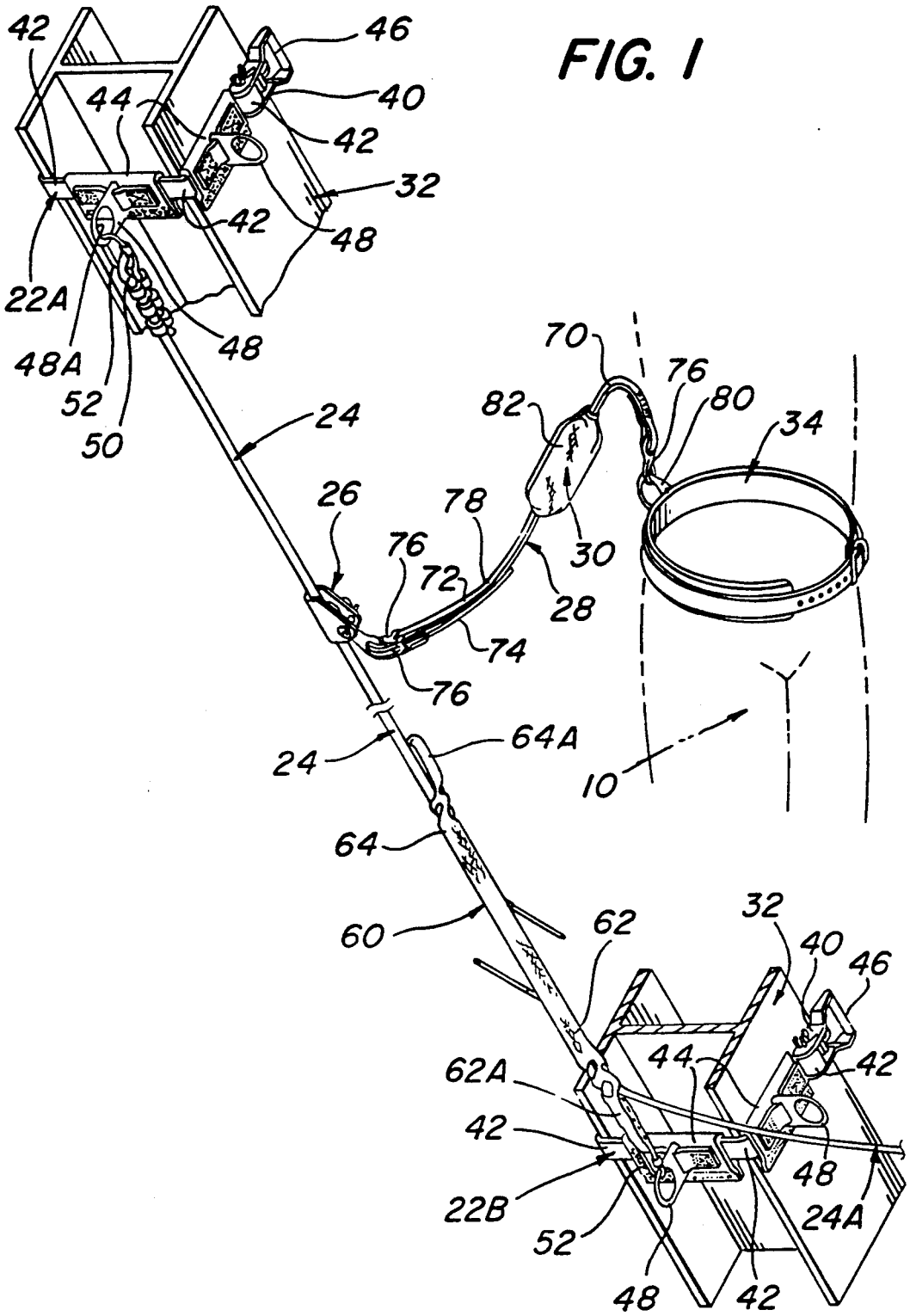
FIG. 1 is an isometric view of a safety system constructed in accordance with this invention.
Figure 2:
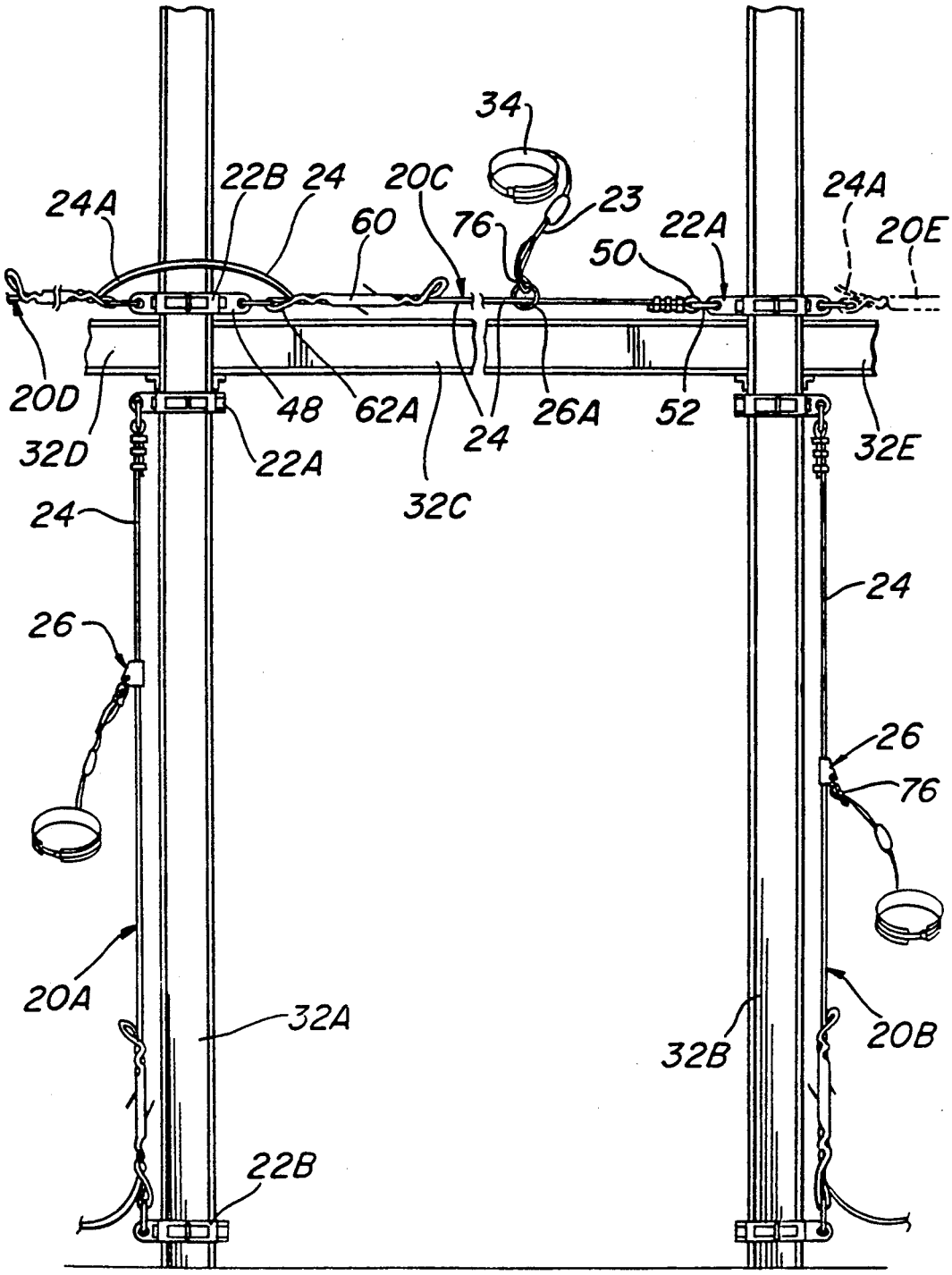
FIG. 2 is a side elevational view of a building being constructed by a worker utilizing the system of this invention.

Referring now to the various figures of the drawing wherein like reference characters refer to like parts, there is shown at 20 in FIG. 1, a safety system constructed in accordance with this invention. The system 20 is arranged, when connected to some fixed or static structure, e.g., the I-beam framework of a building under construction or renovation such as shown in FIG. 2, to protect a worker 10 (shown in phantom lines in FIG. 1) from falling. To that end, the safety system 20 is arranged to be secured to a portion of the static structure.

As can be seen clearly in FIG. 1, the safety system 20 basically comprises at least two releasably securable mounting assemblies 22A and 22B, an elongated rope or cable 24, a sliding anchor device 26, a dual-headed lanyard 28, and a shock absorber 30. The sliding anchor device 26 may take various forms, depending upon the application for the safety system, as will be described later.

Each of the mounting assemblies 22A and 22B is arranged to be secured to respective portions of one or more elongated structural members 32, e.g., an I-beam, of a building or other static structure being erected, repaired, reconstructed, etc. The rope 24 is of any suitable conventional construction, e.g., braided nylon or polyester, and is arranged to connected between the two mounting assemblies 22A and 22B. In the embodiment shown the rope is connected between one mounting assembly 22A located adjacent one end of one I-beam 32 and a second mounting assembly 22B located adjacent the opposite end of the I-beam. Preferably the rope is taut or substantially taut so that it extends generally parallel to the I-beam. The means for connecting the rope to the mounting assemblies will be described later.

The sliding anchor member 26 is mounted on the rope 24 and is arranged to be slid therealong. If the I-beam is oriented vertically, such as shown in FIG. 1, the sliding anchor member 26 is constructed so that it can be actuated to releasably secure it at any desired position, e.g., height, on the rope. Thus, as shown in FIG. 1 the sliding anchor member 26 comprises a conventional rope grab (to be described later). If the I-beam is oriented horizontally (as some are shown in FIG. 2) the sliding anchor member is constructed to freely slide along the rope, e.g., the sliding anchor comprises a conventional O-ring. In either case the lanyard 28 is arranged to be connected to the sliding anchor member 26 and some safety device 34, e.g., a belt, worn by the worker 10 to connect the worker to the sliding anchor member. The shock absorber 30 is connected within a portion of the lanyard 28 and serves to absorb the shock if the worker 10 should fall from the structure once he/she is connected to the sliding anchor.

Turning now to FIG. 1, the details of the mounting assemblies 22A, 22B, etc., will be discussed. Each of the mounting assemblies 22A, 22B, etc., is identical and as described in my aforenoted patent application basically comprises a ratchet assembly 40, a flexible strap 42, and at least one sleeve assembly 44. The strap 42 is arranged to encircle the structural member, e.g., the I-beam 32, with the ratchet assembly locking it tightly in place thereon. Each sleeve assembly 44 is mounted on the strap 42 and serves as a means for connecting the rope 24 thereto (as will be described later).

The strap 42 is formed of a woven, high strength material, e.g., nylon or polyester, webbing. In one preferred embodiment of this invention, the strap is approximately 2 inches (5.1 cm) wide and approximately 65 inches (165.8 cm) long. Other lengths of between 4 and 10 feet are equally effective, as may be almost any other length, depending upon the circumstances of use.

The ratchet assembly 40 is secured to one end of the strap 42. This is accomplished by folding the strap end over itself about a pin of a base portion of the ratchet assembly, and sewing the folded portion and contiguous portion of the strap end together. The ratchet assembly is arranged to releasably receive the opposite free end of the strap 42 so that the strap can be formed into a loop to encircle the I-beam as shown in FIG. 1, and then tightly drawn thereabout. The ratchet assembly includes a handle member 46 to be grasped by the user and pivoted with respect to the assembly to reel the strap so that the extending loop of the strap is tightened about the I-beam 32 to be resistant to accidental release or slippage.

Each sleeve 44 comprises a tubular member formed of the same webbing material forming the strap. The strap 42 extends through the sleeve 44. At least one conventional D-ring 48 is fixedly mounted on the sleeve 44, but is free to pivot with respect thereto to facilitate the connection of the rope 24 to it.

When a worker wishes to connect the mounting assembly 22A onto the I-beam 32 its strap 42 is placed about the I-beam at a desired position thereon, e.g., adjacent one end of the I-beam, and threaded into the ratchet mechanism. The handle 46 of the ratchet mechanism is then repeatedly pivoted to reel the strap up, thereby tightening the loop of the strap about the I-beam until the mounting assembly 22A is frictionally secured in place on the I-beam.

In accordance with one exemplary embodiment of the subject invention the mounting assembly 22B is secured to the I-beam at a second location thereon, e.g., adjacent its other end, in the same manner as just described. Once both mounting assemblies are secured in place on the I-beam, the worker 10 may then connect the rope 24 between them so that it is relatively taut and extends parallel to the I-beam. In order to secure the rope 24 to the mounting assemblies, the rope preferably includes at least one spliced-eye end 50. The end 50 of the rope 24 is connected to a D-connector 48 on one of the sleeves 44 of the mounting assembly 22A, via a conventional connector, e.g., a carabiner 52. In particular, the carabiner 52 is extended through the opening in the spliced-eye 50 of the rope 24 and through the opening 48A in the D-connector.

The rope 24 may be connected to the other mounting assembly 22B in various ways. For example, if the rope is of the same length as the spacing between the two mounting assemblies 22A and 22B, and if it includes a spliced-eye at its other end it may be connected to the mounting assembly 22B in the same manner as its first end is connected to the mounting assembly 22A so that the rope is relatively taut between the two assemblies. More likely an indeterminant length of rope, longer than the spacing between the two mounting assemblies 22A and 22B, will be used. In such a case a frictional engagement connector 60 is utilized as the means for connecting the rope to the mounting assembly 22B. The frictional engagement connector 60 will be described in detail later. Suffice it for now to state that the frictional engagement connector 60 is a tubular member through which the rope 24 extends and includes a pair of ends 62 and 64, each of which is in the form of a respective loop 62A and 64A. When the ends 62 and 64 of the member 60 are pulled away from each other the connector frictionally engages the rope passing therethrough to releasably secure the connector to the rope.

In order to secure the rope 24 to the mounting assembly 22B the frictional engagement connector 60 is mounted on the rope 24 immediately adjacent the mounting assembly 22B when the rope 24 is pulled relatively taut. The connector 60 is then fixed in position on that rope by pulling its opposite ends 62 and 64 apart. Either of the loops 62A or 64A of the connector 60 is arranged to be connected, via a carabiner 52, to the D-connector 48 on one of the sleeves 44 of the mounting assembly 22B. For example, in the embodiment shown herein loop 62A is secured to the mounting assembly 22B via another carabiner 52 which passes through the loop 62A in connector 60 and the opening 48A in the D-connector 48 on one of the sleeves 44 of the mounting assembly 22B.

The tubular member making up the frictional engagement connector 60 formed of plural strands of a strong, light weight, material which are woven or interconnected like a conventional "chinese finger grip" so that the tubular member has a central passageway extending through it between its pair of ends 62 and 64. The ends 62A and 62B include respective openings 62B and 64B to the interior of the central passageway. The heretofore identified loops 62A and 64A extend from the edge of the openings 62 and 64, respectively. In order to position the connector 60 on the rope at a desired position the two ends 62 and 62 of the sliding anchor's tubular member are pushed towards each other. This causes the elongated tubular member to decrease in length and increase in internal diameter, so that the internal diameter of its central passageway is greater than the external diameter of the rope 24. This enables the frictional engagement connector 60 to be readily slid to the desired position on the rope 24. In order to fix or secure the connector at that position so that it cannot slide with respect to the rope, all that is necessary is for the worker 10 to pull the ends 62 and 64 of the connector apart by gripping its loops 62A and 64A and pulling them away from each other. This action causes the connector to elongate, and its central passageway to constrict in internal diameter, whereupon, the interior surface of the central passageway tightly engages the exterior surface of the rope 24. The resulting high friction created by this action precludes the connector from sliding along the rope.

The lanyard is best seen in FIG. 1 and as described in my aforementioned patent application basically comprises plural, e.g., two, straps of material, which are secured together to form three strap sections, namely, a common strap section 70 and a pair of strap sections 72 and 74. Each of the strap sections 72, 74, and 70 is an elongated member which includes a free end at which a conventional connector, e.g., a spring clasp 76 is mounted. The opposite end of each of the sections are secured together at a joint 78.

The common lanyard section 70 is arranged to be connected to the waist belt 34 worn by the worker 10 by attaching the spring clasp 76 at the end of that lanyard section 70 to a D-ring 82 mounted on the safety belt 34. Both of the lanyard's strap sections 72 and 74 are arranged to be connected to the sliding anchor 26 to complete the securement procedure. That is accomplished by connecting the clasps 76 at the ends of lanyard sections 72 and 74 to an eyelet of the rope grab 26 of FIG. 1. As mentioned earlier and as will be described later when the lanyard 28 is to be connected to a horizontally extending rope the sliding anchor comprises a conventional 0-ring to which the clasps 76 at the ends of lanyard sections 72 and 74 are connected.

The lanyard 28 can be used alone, or in combination with a shock absorber 30. In the embodiment shown herein a shock absorber is used and is preferably constructed in accordance with the embodiment of FIGS. 4–6 of my aforenoted patent application, except that the common strap section 70 described heretofore is utilized in lieu of a rope. The shock absorber 30 basically comprises a shock absorbing mechanism housed within a readily openable cover 82. The shock absorber is arranged so that when tension is applied to the lanyard 28, such as occurs when the worker falls, its internal mechanism absorbs the energy of the shock.

If desired, for applications wherein the rope is vertical the sliding anchor 26 may be constructed as described in my aforenoted patent application Ser. No. 07/771,666 (and hence like the frictional engagement connector 60) in lieu of a conventional rope grab.

As can be seen clearly in FIG. 1, the free end 24A of the rope 24 extends beyond the mounting assembly 22B. Thus, that rope portion can be coiled up. Alternatively, it may be used as a part of another safety system 20 for the structure being erected. In this regard, and in accordance with one aspect of this invention, as shown in FIG. 2, plural systems 20 may be mounted between adjacent structural members, e.g., I-beams, to enable the worker to move from one area of the structure to another, all the while being protected from falling. In achieving that end one single rope 24 may be used for more than one system 20. For example, as can be seen in FIG. 2 two systems 20A and 20B, each constructed in the same manner as described heretofore may be mounted on respective vertical I-beams 32A and 32B of the first level (floor) of the structure being erected, to enable a worker 10 to scale the beams and/or to work at any height therealong, while protecting him/her from a fall. The second level (floor) of the structure may include plural systems 20C and 20D for protecting workers located adjacent horizontal I-beams 32C and 32D, respectively, making up that level. As seen in FIG. 2, the two systems 20C and 20D make use of a common rope 24. In particular, the system 20C is mounted adjacent the I-beam 32C by securing its connector assembly 22A onto the vertical I-beam 32B adjacent the connection to I-beam 32C. The rope 24, with its end 50 is secured to the D-connector 48 on the assembly 22A using a carabiner 52 (or other removable snap ring). The opposite end of the safety system 20C is connected to the D-connector 48 on the connector assembly 22B located on the vertical I-beam 32A adjacent the connection to I-beam 32C. The means for connecting the rope 24 to the mounting assembly 22B comprises the heretofore identified frictional engagement connector 60 (and another carabiner 52 or other removable snap ring). The free end portion 24A of rope 24 extending beyond the connector 60 of the safety system 20C extends through a second frictional engagement connector 60. That later connector forms a portion of the safety system 20D. The connector 60 of system 20D is in turn secured to another D-ring 48 on the mounting assembly 22B, via another carabiner 52 (or other removable snap ring), and is actuated so that it is frictionally secured in position on the rope section 24A. The rope 24A section located at the other end of the system 20D is connected to another structural member (not shown) by yet another frictional engagement connector 60 (not shown) connected via another carabiner 52 or other removable snap ring (not shown) to another mounting assembly (not shown). Other systems constructed in accordance with this invention can be secured to other portions of the structure being erected. For example, another system 20E, shown by phantom lines in FIG. 2, may be secured to the I-beam 32B to extend along a horizontal I-beam section 32E.

In each safety system 20 wherein the rope 24 extends horizontally, e.g., the systems 20C, 20D, 20E, the sliding anchor 26, comprises a conventional O-ring or some other hollow or tubular member through which the rope 24 passes so that it can freely slide on the rope and so that the worker may be secured to it (as described earlier) to protect him/her when he/she is working adjacent the associated I-beam 32.

As should be appreciated by those skilled in the art the safety systems of this invention provide a means to enable a worker to work at an elevated location and to move freely thereabout, all the while protecting him/her from falling. In addition, the system 20 enables the worker to expeditiously erect or repair a structure using plural structural components, while protecting him/her from falling. Thus, as shown in FIG. 2, two I-beams 32A and 32B can be erected so that they are oriented vertically, with each I-beam having its own safety system 20 constructed in accordance with this invention mounted thereon. Alternatively one safety system can be used and moved to the desired I-beam. In either case the system enables a worker to work on the structure adjacent either beam at any height while being protected from falling. Thus, the worker can use the safety system 20 as a means to protect himself/herself while either working or scaling the I-beam. When the worker is located at the next level (floor) of the structure, e.g., the level of the horizontal I-beams 32C, 32D, and 32E, the systems 20C, 20D, and 20E can be mounted on the structure to enable the worker to move about that level, yet be protected from falling.

The use of the lanyard 28 constructed in accordance with the teaching of my aforenoted patent application facilitates the worker's movement from one system to the other. For example, if the worker is located on I-beam 32C and is connected to the sliding anchor (O-ring) 26 of the system 20C, but wants to go to the I-beam section 32D all that is required is to move down the I-beam to the end of the system 20C closest to system 20D (the O-ring being freely slidable permits such action without the worker having to do anything other than to walk down to the new location). Then one of the lanyard sections 72 or 74 is disconnected from the sliding anchor (O-ring) 26 of the system 20C, leaving the other lanyard section secured to protect the worker from a fall. The disconnected lanyard section 72 or 74 can then be connected to the sliding anchor 26 (O-ring) (not shown) forming a portion of the safety system 20D. Once this has been accomplished the lanyard section which had remained connected to the sliding anchor (O-ring) of system 20C can then be disconnected therefrom and connected to the sliding anchor (O-ring) of the system 20D, thereby completing the transfer and enabling the worker to position himself/herself at any point along the rope 24 making up the system 20D.

Without further elaboration, the foregoing will so fully illustrate my invention that others may, be applying current or future knowledge, adopt the same for use under various conditions of service.

I claim:

1. A safety system for connection to at least one fixed, elongated, structural component of a static structure to prevent a worker located on said structure from falling, said system comprising first and second releasably securable means, rope means, and sliding anchor means, said first releasably securable means being arranged for encircling and frictionally engaging a first portion of said structural component, said second releasably securable means being arranged for encircling and frictionally engaging a second portion of said structural component, said second portion of said structural component being spaced from said first portion thereof, wherein each of said releasably securable means comprises (a) an elongated strap formed of a strong and flexible material having first and second end portions, (b) receiving means fixedly secured to said first end portion of said strap for receiving said second end portion of said strap so that said strap encircles said structural component, (c) releasable locking means comprising a ratchet assembly enabling said encircling strap to be pulled tightly around said structural component into good frictional engagement therewith and to hold said strap in said position against accidental release therefrom and (d) at least one sleeve through which said strap extends, said sleeve being slidable along said strap and having a connector secured thereto, said rope means being connected between said sleeves of said first and second releasably securable means by at least one frictional engagement connector connected to said connector, said sliding anchor means comprising a member mounted on said rope means for generally unobstructedly sliding therealong to a desired position between said first and second releasably securable means, whereupon said sliding anchor means may be releasably secured against further sliding, said sliding anchor means additionally comprising means for connection to a safety device worn by a worker to secure the worker to said sliding anchor means, whereupon said worker is prevented from falling more than a predetermined distance away from said sliding anchor means.

2. The system of claim 1 wherein each of said releasably securable means additionally comprises at least one connector fixedly secured onto said sleeve.

3. The system of claim 1 wherein said frictional engagement connector comprises a flexible tubular member woven of strands of fibers, said tubular member having a pair of ends, a first one of said ends including an extension projecting therefrom, said one extension comprising a first connector, said rope means extending through said tubular member, said tubular member when compressed longitudinally having a sufficiently large internal diameter that said rope means may slide therethrough, said tubular member being arranged to be extended longitudinally upon the application of a pulling force to each of said ends, whereupon said internal diameter is reduced so that said rope means is tightly frictionally engaged by said tubular member to preclude said tubular member from sliding along said rope means.

4. The system of claim 2 wherein said frictional engagement connector comprises a flexible tubular member woven of strands of fibers, said tubular member having a pair of ends, a first one of said ends including an extension projecting therefrom, said one extension comprising a second connector, said rope means extending through said tubular member, said tubular member when compressed longitudinally having a sufficiently large internal diameter that said rope means may slide therethrough, said tubular member being arranged to be extended longitudinally upon the application of a pulling force to each of said ends, whereupon said internal diameter is reduced so that said rope means is tightly frictionally engaged by said tubular member to preclude said tubular member from sliding along said rope means.

5. The system of claim 1 wherein said safety device worn by said worker comprises a flexible member having first, second, and third, elongated sections, each of said sections having a first end and a second end, said second ends of all of said sections being connected to one another, each of said first ends including a respective connector member mounted thereon, said connector member of said first section being arranged to be releasably secured to said safety device worn by said worker, said connector members of said second and third sections being arranged to be releasably secured to said sliding anchor means.

6. The system of claim 5 wherein each of said sections comprises a web of flexible material.

7. The system of claim 1 wherein said safety device worn by said worker comprises a flexible member having a first end arranged to be connected to the worker, a second end arranged to be connected to said sliding anchor means, and shock absorber means for absorbing the shock of a fall interposed between said first and second ends of said flexible member.

8. A method of connecting various elongated structural members together by a worker located at an elevated position adjacent one of said structural components, while protecting said worker from falling from said elevated position, said method comprising (a) mounting first releasably securable means on a first portion of one of said structural components so that a portion of said first releasably securable means encircles and frictionally engages said first portion of said structural component, said first releasably securable means including a sleeve slidable thereon and having a connector secured thereto, (b) mounting second releasably securable means on a second portion of one of said structural components so that a portion of said second releasably securable means encircles and frictionally engages a second portion of said one structural component remote from said first portion, said second releasably securable means including a sleeve slidable thereon, (c) extending rope means between said sleeves of said first and second releasably securable means and connecting said rope means said connectors by at least one frictional engagement connector so that said rope means is substantially taut, (d) providing sliding anchor means on said rope means, said sliding anchor means being arranged to slide generally unobstructedly along said rope means to a desired position and being actuatable so that it may be releasably secured on said rope means against further sliding, and (e) connecting said worker to said sliding anchor means.

9. The method of claim 8 additionally comprising releasing said sliding anchor from said desired position and sliding it along said rope means to a new position, while said worker remains connected thereto.

10. The method of claim 9 additionally comprising actuating said sliding anchor at said new location to releasably secure it in position thereat.

11. The method of claim 8 wherein said method is repeated to add another structural component to said static structure.

12. The method of claim 8 wherein said method additionally comprises said worker wearing a safety device, said safety device being connected to said sliding anchor means by lanyard means, said lanyard means comprising a common section and a pair of sections connected thereto, said common section being releasably secured to said safety device, each of said pair of sections being arranged to be releasably connected to said sliding anchor means.

13. The method of claim 12 additionally comprising connecting shock absorbing means between said safety device and said sliding anchor means.

14. The method of claim 12 wherein both of said pair of sections of said lanyard means are connected to said sliding anchor means at some time and thereafter a first one of said pair of sections is disconnected therefrom and connected to some other means, and once said first one of said pair of sections is connected to said some other means, said other one of said pair of sections is disconnected from said sliding anchor means and then connected to said some other means.

15. The method of claim 14 wherein said some other means comprises another sliding anchor means.

16. The method of claim 11 wherein said structural component is oriented vertically to have a lower end and an upper end, with said first releasably securable means being connected adjacent said lower end and with said second releasably securable means being connected adjacent said upper end, whereupon said worker makes use of said system to elevate himself/herself along said component.

17. The method of claim 16 additionally comprising adding another structural component to said structure, said other structural component being oriented horizontally, whereupon said method additionally comprises releasably securing first and second releasably securable means, rope means and sliding anchor means on said other structural component in a similar manner to that of said vertically oriented structural component, whereafter said worker transfers from the sliding anchor means associated with said vertically oriented structural component to the sliding anchor associated with said horizontally oriented structural component.

18. The method of claim 17 wherein said method additionally comprises said worker wearing a safety device, said safety device being connected to said sliding anchor means associated with said vertically oriented structural component by lanyard means, said lanyard means comprising a common section and a pair of sections connected thereto, said common section being releasably secured to said safety device, each of said pair of sections being arranged to be releasably connected to said sliding anchor means associated with said vertically oriented structural component.

19. The method of claim 18 wherein both of said pair of sections of said lanyard means are connected to said sliding anchor means associated with said vertically oriented structural component, thereafter a first one of said pair of sections is disconnected therefrom and connected to the sliding anchor means of said horizontally oriented structural component, and once said first one of said pair of sections is connected thereto said other one of said pair of sections is disconnected from the sliding anchor means associated with said vertically oriented structural component and then connected to said sliding anchor means of said horizontally oriented structural component.

* * * * *